US010709165B2

(12) United States Patent
Fuisz et al.

(10) Patent No.: US 10,709,165 B2
(45) Date of Patent: Jul. 14, 2020

(54) VAPORIZABLE TOBACCO WAX COMPOSITIONS

(71) Applicant: BOND STREET MANUFACTURING LLC (a Florida LLC), Surfside, FL (US)

(72) Inventors: Joseph Fuisz, Surfside, FL (US); Seamus Henry, Ft Lauderdale, FL (US)

(73) Assignee: BOND STREET MANUFACTURING LLC, Surfside, FL (US)

( * ) Notice: Subject to any disclaimer, the term of this patent is extended or adjusted under 35 U.S.C. 154(b) by 0 days.

(21) Appl. No.: 15/276,902

(22) Filed: Sep. 27, 2016

(65) Prior Publication Data

US 2018/0084821 A1 Mar. 29, 2018

(51) Int. Cl.
*A24B 15/167* (2020.01)
*A24B 15/24* (2006.01)

(52) U.S. Cl.
CPC ..... *A24B 15/167* (2016.11); *A24B 15/24* (2013.01)

(58) Field of Classification Search
CPC ..... A24B 15/167; A24B 15/24
USPC ..... 131/352
See application file for complete search history.

(56) References Cited

U.S. PATENT DOCUMENTS 1,624,155 A 4/1927 Amster
2,128,043 A 8/1938 Gamer
4,708,151 A * 11/1987 Shelar ..... A24D 1/14 131/359
4,936,920 A 6/1990 Keritsis et al.
6,907,887 B2 * 6/2005 Conkling ..... A24B 15/10 131/270
7,425,292 B2 9/2008 Yang et al.
7,666,337 B2 2/2010 Yang et al.
7,824,588 B2 11/2010 Yang et al.
7,897,080 B2 3/2011 Yang et al.
7,972,618 B2 7/2011 Fuisz et al.
8,017,150 B2 9/2011 Yang et al.
8,241,661 B1 8/2012 Fuisz et al.
8,314,591 B2 * 11/2012 Terry ..... A24F 47/008 320/114
8,479,747 B2 * 7/2013 O'Connell ..... A24B 15/24 131/300
8,603,514 B2 12/2013 Yang et al.
8,613,285 B2 12/2013 Fuisz
8,617,589 B2 12/2013 Fuisz et al.
8,652,378 B1 2/2014 Yang et al.
8,663,687 B2 3/2014 Myers et al.
8,685,437 B2 4/2014 Yang et al.
8,863,754 B2 10/2014 Renaud et al.
8,887,737 B2 11/2014 Howell et al.
8,906,277 B2 12/2014 Yang et al.
9,038,644 B2 5/2015 Brown et al.
9,108,340 B2 8/2015 Yang et al.
2006/0257463 A1 11/2006 Mahmoud et al.
2008/0286341 A1 * 11/2008 Andersson ..... A23G 3/343 424/440
2009/0098192 A1 4/2009 Fuisz
2011/0079231 A1 * 4/2011 Borushek ..... A24F 1/30 131/229
2011/0083679 A1 * 4/2011 Liu ..... A24B 15/284 131/275
2011/0192409 A1 * 8/2011 Jurado ..... A24F 13/02 131/328
2011/0318390 A1 12/2011 Fuisz et al.
2012/0000478 A1 * 1/2012 Wagenhals ..... A24F 13/04 131/329
2013/0298905 A1 * 11/2013 Levin ..... A24F 47/008 128/202.21
2014/0166028 A1 * 6/2014 Fuisz ..... A24D 1/002 131/328
2014/0261479 A1 * 9/2014 Xu ..... A24B 15/38 131/290
2014/0299137 A1 * 10/2014 Kieckbusch ..... A24F 47/008 131/328
2014/0345631 A1 * 11/2014 Bowen ..... A24B 15/16 131/328
2015/0013695 A1 * 1/2015 McNeal ..... A61K 45/06 131/328
2015/0040922 A1 * 2/2015 Dube ..... A24B 15/18 131/275
2016/0309775 A1 * 10/2016 Parker ..... A24B 15/26
2016/0353799 A1 * 12/2016 Otto ..... A24F 47/008

FOREIGN PATENT DOCUMENTS

WO 2016050472 A1 7/2016

OTHER PUBLICATIONS

Let's brainstorm a wickless ecig! (104 heads are better than one), ECF Forums, https://www.e-cigarette-forum.com/threads/lets-brainstorm-a-wickless-ecig-104-heads-are-better-than-one.543930/, published Mar. 25, 2014.*
Supercritical CO2 Extraction, Eden Labs LLC, published Sep. 24, 2016, https://web.archive.org/web/20160924060606/https://www.edenlabs.com/processes/co2-extraction.*

* cited by examiner

*Primary Examiner* — Eric Yaary
*Assistant Examiner* — Russell E Sparks
(74) *Attorney, Agent, or Firm* — Fitch, Even, Tabin & Flannery, LLP

(57) ABSTRACT

The invention relates to tobacco wax compositions suitable for use in a vaporizer. The tobacco wax may comprise additional excipients including vapor agents, penetration agents, buffer agents, and rheological agents. The composition contains nicotine. The tobacco wax composition leaves a minimum of residue in the vaporizer when used.

9 Claims, No Drawings

VAPORIZABLE TOBACCO WAX COMPOSITIONS

BACKGROUND OF THE INVENTION

In 1926, Samual Amster of Richmond, Kentucky described the extraction of a "wax like substance" from tobacco using a hot water process and then subjecting the resulting liquor to an evaporative step. Despite this extraction, Amster teaches that the (extracted) tobacco "may still be employed for smoking and chewing tobacco." Amster teaches the use of the tobacco "wax like substance" in candles, shoe polishes and varnish (U.S. Pat. No. 1,624,155).

In 1936, James Garner of Mount Lebanon, Pa., described a method to de-nicotinize tobacco, whereby ammonia treated tobacco is subjected to a butane-solvent based extraction method. When the butane is evaporated, "there is left a mass of nicotine and tobacco wax which together may amount to as much as 6-8% by weight of the tobacco used . . . . Tobacco wax or resin is dark brown in color, burns with the production of acrid fumes, and has a strong odor resembling that of an "old" pipe." The tobacco wax may be used as an insecticide or may be "returned to the residual tobacco leaves and also to untreated tobacco leaves to impart thereto desirable flavors." Like Amster, Garner teaches that the extracted tobacco is still suitable use in smoking and other tobacco products (U.S. Pat. No. 2,128,043).

Despite this eighty year old work, Applicants are not aware that the teachings of Amster or Garner have been used in commercial processes or products.

Entering the present era, Keritsis et al (assigned to Philip Morris) (U.S. Pat. No. 4,936,920)(1990) mentions tobacco wax in a list of saccharides and polysaccharides that may be used as a bonding agent when making manufactured tobacco (more typically referred to as reconstituted tobacco sheet).

Renaud et al., in U.S. Pat. No. 8,863,754 (assigned to Philip Morris) (2014) describe compositions for heat not burn applications. The patent mentions tobacco wax in a reference to degradation products the presence of which evidences (unwanted) combustion: "Isoprene is a pyrolysis product of isoprenoid compounds present in tobacco, for example in certain tobacco waxes, and can be present in the aerosol only if the strands of homogenized tobacco material are heated to a temperature substantially higher than that required to generate an aerosol. Thus, isoprene yield can be taken as representative of the amount of homogenized tobacco material that is "over heated."" Nothing in the disclosure indicates that tobacco wax has been purposefully used in this composition or otherwise present than through the natural presence of wax in the tobacco used to manufacture the "homogenized tobacco material." Applicant understands the substrate described in this art to be a reconstituted tobacco sheet intended for use in heat not burn applications.

Brown et al. (assigned to Lorillard)(U.S. Pat. No. 9,038,644)(2015) teaches tobacco wax for use as a phase transition material to impart reduced ignition propensity to a cigarette. The wax is applied to the cigarette paper using high precision wax jet printing.

Each of U.S. Pat. Nos. 1,624,155; 2,128,043; 4,936,920; 4,936,920; 8,863,754; and 9,038,644, is expressly incorporated herein together with all citations in these references.

The vaporization of nicotine containing liquids is well known and popular, including using devices such as electronic cigarettes and tank-style (and non tank) personal vaporizers. Typically such compositions include USP (99.9% pure) nicotine oil as an ingredient, though zero-liquids without any nicotine are also used.

Heat not burn tobaccp systems are known in the tobacco industry. Heat not burn systems like Pax Lab's Pax® and Philip Morris' IQOS® (as well as earlier versions of IQOS® sold as Heatbar® and Accord®) heat tobacco compositions substantially without burning the tobacco, thereby aerosolizing volatile constituents of the tobacco composition. After use, the non-vaporized components of the tobacco composition remain minus those components what were successfully vaporized (or inadvertently burned).

In the case of both Pax® and IQOS® this residue is substantial and represents the substantial mass of the original tobacco composition.

Philip Morris International (PMI) describes the rationale behind heat not burn systems thusly: "[t]he concept behind 'heat-not-burn' is that heating tobacco, rather than burning it, reduces or eliminates the formation of many of the compounds that are produced at the high temperatures associated with combustion. Research has demonstrated that most of the harmful and potentially harmful constituents (HPHCs) in cigarette smoke are formed by thermal breakdown of the tobacco when it is burned. Heat-not-burn therefore offers the possibility of significantly reducing both the number and the levels of HPHCs generated by tobacco products, whilst retaining an acceptable sensory experience for current adult smokers" (from pmiscience.com).

Now, some criticism has been leveled against heat not burn systems, which ostensibly is premised on the notion that tobacco and heat will always tend lead to toxicant formation. Stephen Stotesbury, head of scientific and regulatory affairs for Imperial Tobacco has been quoted saying about Philip Morris International's IQOS [heat not burn] system: "There's a lot of black crud in the iQOS device after using it . . . . It smells like an ashtray." Perhaps not surprisingly, Imperial Tobacco has stated it will not develop a heat not burn product—presumably to rely solely on its electronic nicotine delivery systems (ENDS).

Pax is a loose-leaf style vaporizer for use with "loose-leaf plant material" supplied by the user herself (-www.paxvapor.com/support/pax-2-faq/#can-i-use-liquids-in-pax-2). An earlier heat not burn composition—Pax Labs' Ploom® used a tobacco-humectant composition contained in a capsule of the style produced (filled with coffee) by NESCAFÉ®—however this product has been discontinued.

Philip Morris' IQOS is a more sophisticated product wherein the user uses a manufacturer-supplied "cigarette" in the heating device. The cigarette itself is comprised of reconstituted tobacco sheet made with high amounts of humectant (glycerin) that, together with other volatiles, create a vapor like experience when used.

Applicants believe the composition of the reconstituted sheet used in IQOS is akin to that described in WO2016050472A1, assigned to Philip Morris. One of the present inventors has extensive experience working with film and sheet systems, principally for pharmaceutical applications and is a named inventor on Fuisz et al. U.S. Pat. Nos. 9,108,340; 8,906,277; 8,685,437; 8,663,687; 8,652,378; 8,617,589; 8,613,285; 8,603,514; 8,241,661; 8,017,150; 7,972,618; 7,897,080; 7,824,588; 7,666,337; and 7,425,292.

Heat not burn systems does reduce HPHCs as stated by the PMIScience excerpt above. The toxicant profile of burning tobacco is well understood. Researchers have estimated that cigarette smoke contains 7,357 chemical compounds from many different classes (Warnatz, J, U Maas and R W Dibble. Combustion: physical and chemical fundamentals, modeling and simulation, experiments, pollutant formation. 2006). There is broad scientific agreement that several of the major classes of chemicals in the combustion emissions of burned tobacco are toxic and carcinogenic (Rodgman, A, and T A Perfetti. The chemical components of tobacco and tobacco smoke. 2013: CRC press).

BRIEF SUMMARY OF THE INVENTION

This invention is directed towards tobacco wax, including methods of manufacture, tobacco wax compositions, and the vaporization of tobacco wax for use in a vaporizer-inhalation device.

One aspect of the invention is directed to a vaporizable tobacco wax composition comprising tobacco wax and a vapor agent.

The vapor agent is present in the final composition.

The vapor agent can be present in the amount of 10-25% by mass.

The final composition can have a nicotine content of 1.5-4%.

The composition can have a TSNA content less than 3 ppm.

The composition may further comprise a flavor.

In another aspect of the present invention, a vaporizable tobacco wax composition comprises tobacco wax and a penetration agent.

In another aspect of the present invention, a vaporizable tobacco wax composition comprises tobacco wax and a buffer agent.

DETAILED DESCRIPTION OF THE INVENTION

The present invention teaches a composition that comprises tobacco wax and other ingredients suitable for vaporization and use by a mammal. Applicants have found that the vaporization of a tobacco wax based composition provides excellent organaleptics and nicotine delivery. Moreover, unlike existing heat not burn compositions, applicants have found tobacco wax compositions of the present invention vaporize substantially in their entirety (i.e. substantially without residue).

Tobacco wax based compositions allow for a heat-not-burn tobacco product that is not a liquid, and does not require specialized reconstituted sheet production or use, or use conventional tobacco leaf products (like Pax).

The role of plant wax for plants is understood. Plants secrete waxes into and on the surface of their cuticles as a way to control evaporation, wettability and hydration. The epicuticular waxes of plants are mixtures of substituted long-chain aliphatic hydrocarbons, containing alkanes, alkyl esters, fatty acids, primary and secondary alcohols, diols, ketones, aldehydes. From the commercial perspective, the most important plant wax is carnauba wax, a hard wax obtained from the Brazilian palm *Copernicia prunifera*.

B. R. Jordan describes tobacco wax as consisting of three major components: straight chain hydrocarbon (C27-C33 comprising 59%); branched-chain hydrocarbons (C25-C32 comprising 38%) and fatty acids (C14-C18 comprising 3%) (Advances in Botanical Research, Vol 22, "UV-B Radiation: A Molecular Perspective, hereby incorporated by reference as if fully set forth herein).

Various processes for extracting wax from plant materials can be employed in connection with the present invention. These extraction methods include, without limitation, sub-critical CO2 extraction; supercritical CO2 extraction; super-critical extraction with additional (non-CO2) solvents; maceration; digestion (a heated form of maceration); decoction; percolation; hot continuous extraction (Soxlet); Aqueous Alcoholic Extraction by Fermentation; Counter-current Extraction; Ultrasound Extraction (Sonication); and the Phytonics Process. This list is non-limitative as skilled artisans will appreciate and other suitable extraction methods may be employed. Solvents used may be polar or non-polar. Various combinations and/or sequential series of these methods can be used.

The non-limitative preferred embodiment is supercritical CO2 extraction. The use of supercritical CO2 extraction to de-nicotinize tobacco is disclosed in Howell et al U.S. Pat. No. 8,887,737 (2014), which is hereby incorporated by reference as if fully set forth herein.

Extraction, including the preferred embodiment super-critical CO2 extraction, can be used to generate several partitions form tobacco, broadly speaking, including oils and waxes. Both of these partitions contain nicotine. The wax partition yield should exceed 1.5% of the starting tobacco weight, preferably 2% or greater, most preferably 4% of greater.

All forms of tobacco may be used including tobacco leaf, stem, and waste tobacco dust. Blends of tobacco may be employed. Cigar tobaccos may be employed. Tobacco varieties with high nicotine content are preferred. Because the extraction process may bring flavors and aromas from the leaf into the wax and oil, the tobacco inputs may be selected in whole or in part for taste.

It is expressly contemplated that oils may be mixed into the resulting wax to increase the yield of wax and nicotine. High shear mixers (and other mixing methods) may be used for this purpose. Preferably, the mass of the oil partition added to the wax partition will be less than or about 75% of the mass of the wax partition, preferably less than or about 30% and most preferably less than 15% of the mass of the wax partition (measured by mass). The oil partition can serve to increase nicotine, enhance flavor, increase vapor production and generally extend the yield from tobacco.

Additional excipients may be employed to develop a final composition for vaporization.

Vapor agents may be added to the wax. Vapor agents increase the vapor from the composition when heated. Vapor agents may include, without limitation, vegetable glycerin, non-vegetable forms of glycerin, propylene glycol, polyethylene glycol, polysorbates including polysorbate 20 (polyoxyethylene sorbitan monolaurate), polysorbate 40 (polyoxyethylene (20) sorbitan monopalmitate), polysorbate 60 (polyoxyethylene sorbitan monostearate) and polysorbate 80 (polyoxyethylene sorbitan monooleate), and other agents suitable for increasing the "vapor" from a heated composition. Vapor agents may be added to about 50% of the composition (by mass), preferably 10-25% of the composition (by mass), most preferably 1-10% (by mass) of the composition. High shear mixing is important to ensure uniform distribution of the vapor agent (or other added excipient) in the composition.

The nicotine content of the final composition is preferably less than 12%, more preferably less than 7.5% and most preferably 1.5-4% (by mass). Low nicotine compositions with nicotine less than 1.5% may also be made for users seeking lower nicotine delivery. Nicotine, natural or synthetic, may be added where the tobacco extraction yields a less than desired level. The product can be made from low-nicotine containing tobacco to achieve a low nicotine level, or otherwise subject to known processes to dinicotinize the composition.

Flavors may be added to the wax. Flavors may be synthetic or natural. For purposes hereunder, menthol, wintergreen, peppermint and similar oils used in menthol tobacco products are understood to be flavors, together with traditional flavors (e.g. grape, cherry etc). Tobacco flavors, and traditional tobacco top flavors may be used to impart a rich tobacco flavor. Sustained release flavors, coated particle flavor systems, and flavor capsules with volatile flavors may all be employed.

Penetration agent(s) may be added to the tobacco wax. By penetration agents, we mean an agent that promotes transfer of the active—i.e., a substance that enhances absorption through the mucosa, mucosal coating and epithelium, otherwise known (see U.S. Patent Application Publication No. 2006/0257463 A1, the content of which is incorporated herein by reference). The penetration agent may comprise but is not limited to polyethylene glycol (PEG), diethylene glycol monoethyl ether (Transcutol), 23-lauryl ether, aprotinin, azone, benzalkomin chloride, cetylperidium chloride, cetylmethylammonium bromide, dextran sulfate, lauric acid, lauric acid/propylene glycol, lysophosphatilcholine, menthol, methoxysalicylate, oleic acid, phosphaidylcholine, polyoxyethylene, polysorbate 80, sodium EDTA, sodium glycholated, sodium glycodeoxycholate, sodium lauryl sulfate, sodium salicylate, sodium taurocholate, sodium taurodeoxycholate, sulfoxides, and various alkyl glycosides or, as described in U.S. Patent Application Publication No. 2006/0257463, bile salts, such as sodium deoxycholate, sodium glycodeoxycholate, sodium taurocholate and sodium glycocholate, surfactants such as sodium lauryl sulfate, polysorbate 80, laureth-9, benzalkonium chloride, cetylpyridinium chloride and polyoxyethylene monoalkyl ethers such as the BRIJ® and MYRJ® series, benzoic acids, such as sodium salicylate and methoxy salicylate, fatty acids, such as lauric acid, oleic acid, undecanoic acid and methyl oleate, fatty alcohols, such as octanol and nonanol, laurocapram, the polyols, propylene glycol and glycerin, cyclodextrins, the sulfoxides, such as dimethyl sulfoxide and dodecyl methyl sulfoxide, the terpenes, such as menthol, thymol and limonene, urea, chitosan and other natural and synthetic polymers. Preferably, the penetration agent is selected to be capable of transfer through vaporization.

Buffer agents may be added to the tobacco wax, including without limitation to create static or a dynamic buffer systems. Preferably, the buffer agent is used to raise the pH of the mouth in order to increase nicotine absorption in the buccal cavity in a manner which is based on pka and the Henderson Hasselbach equation. For nicotine, preferably, the pH of the mouth is increased to 7 to 10, preferably 7.8 to 10, most preferably from 8.5 to 9.5. Preferably, the buffer agent increases the pH of the oral cavity for a period of ten minutes or more after administration Buffering agents may be used to control pH, including without limitation, sodium bicarbonate, potassium bicarbonate, sodium carbonate, potassium carbonate, calcium carbonate, dipotassium phosphate, potassium citrate, sodium phosphate and any other such buffer system. The buffer system may be designed to dynamically control the pH of the product taking into consideration the effect of saliva during use, i.e., a dynamic buffer system. Examples of buffer systems to obtain the preferred pH include dibasic sodium phosphate and monobasic sodium phosphate. Both are FDA accepted buffer materials used and listed in the inactive ingredients list. For example, for a pH of 7, the ratio of monobasic/dibasic can be 4.6/8.6; for a pH of 7.5 the ratio of monobasic/dibasic can be 1.9/11.9; and for a pH of 8.0 the ratio of monobasic/dibasic can be 0.6/13.4. These are mathematically calculated buffer numbers and will need to be adjusted according to the other ingredients added to the formula. Thus this dynamic buffer range is adjusted by the amounts of the buffer system since saliva is freshly renewable in the mouth. See Fuisz U.S. Patent Application Publication Nos. 2009/0098192 A1 and US 2011/0318390 A1 discussing dynamic buffering and incorporated herein by reference.

Preservatives may be added to the tobacco wax to preserve freshness and inhibit microbial growth.

Preferably, the composition has maintains a wax like viscosity and/or consistency despite the addition of any excipients. It is generally advantageous that the tobacco wax composition does not flow until under heavy-vaporizing heat. However, it may be beneficial to adjust the rheological properties of the tobacco wax composition. For example, a reduced viscosity and or surface tension may be desired for various reasons, such as packaging convenience (e.g a squeezable tube may be easier to use with reduced viscosity). It may also be beneficial to increase viscosity, for example to prevent flow off a flat heating surface (e.g. a hookah platform. Etc.). Rheology agents may employed to adjust the viscosity, surface tension and other rheological properties of the final product (e.g. gelling agents, tween, etc).

The resulting wax composition may be used by itself, or mixed with other vaporizable compositions both solid and liquid formats. Such mixing may be done by the manufacturer or by the user. Liquid formats including without limitation e-liquid type products. Solid formats include without limitation other waxes from tobacco or other plant or botanical materials. Mixing can also take place by blending the plant or botanical materials which are subjected to the extraction process.

The wax composition of the present invention is intended to be vaporized. Suitable devices include any device capable of sufficiently heating the composition to cause it to vaporize and still not substantially burn the composition. Non-limitative examples of suitable devices include devices marketed as dry herb vaporizers. Suitable temperature ranges for the vaporizer heating element range from temperature needed to vaporize the composition and below the auto ignition temperature of the composition.

Suitable battery parameters ranging from 1 Amp continuous output to 30 Amp continuous output.

The wax composition of the present invention is substantially vaporizable, meaning that it will be substantially vaporized when heated in a suitable device. It is desirable that residue is minimized, including inter alia to avoid the need to clean the device between uses.

The tobacco wax composition of the present invention when vaporized, emits lower levels or HPHC's than conventional tobacco products, e.g. cigarettes. The tobacco wax composition, when used in a suitable vaporizer, results in less than 25%, on average, of the levels of HPHC's from a US-sold Marlboro Red (using comparable methods to measure e.g. Canadian method), preferable less than 10% and most preferably less than 5%. It is desirable to mitigate the levels of tobacco specific nitrosamines in the composition. The tobacco wax composition has TSNA levels preferably less than 10 parts per million (ppm, more preferably less than 3 ppm, most preferably less than 1 ppm.

Example A

Tobacco wax was removed from tobacco leaf using supercritical CO2 extraction. Tobacco oil was mixed in with the wax, while retaining a wax consistency. The material was fragrant and dark brown in color. A nicotine assay indicated a nicotine strength for the tobacco wax of 4%. The wax was placed in a dry herb vaporizer and vaped by a healthy adult male. The tobacco wax vaporized creating a nice vapor volume. The nicotine delivery was strong and the product was fragrant with tobacco fragrance. The tobacco wax substantially vaporized leaving minimal residue on the heating coil.

Example B

The tobacco wax of Example A was taken and 10% of vegetable glycerin and 5% of propylene glycol (measuring by weight of the final composition) was added. The tobacco wax accepted the addition of these vapor agents. The resulting composition was placed in a dry herb vaporizer and used by a healthy adult male. The flavor was excellent and the vapor production was increased from Example A.

Example C

The tobacco wax of Example A was taken and grape flavor from Tobacco Technology, Maryland was added, at 3.5% of the composition. The resulting tobacco wax composition was placed in a dry herb vaporizer and used by a healthy adult male. The grape taste was enjoyed by the user.

Example D

Tobacco wax was extracted from a different of blend tobacco leaf using supercritical CO2 extraction. The tobacco wax was dark with a slightly green tinge. The nicotine content of the tobacco wax was approximately 1.5%. Nicotine glycerin solution (10%) was added to 10% of the final composition weight. The product vaped well but the flavor notes where not as attractive as the tobacco wax of Example A. It was observed that additional flavors could improve the product.

Example E

Oil from the extraction of tobacco described in Example D was added to the tobacco wax of Example D, and the composition was mixed using strong shear forces. The resulting product vaped well and left very little residue.

Example F

Tobacco wax from Example A was placed in a vaporizer. A small amount of zero nicotine flavored e-liquid was added to the vaporizer. The two were not otherwise mixed other than to insert them together. The wax and the zero were vaporized together. A fair amount of residue was left by this mix in the vaporizer. The exercise was repeated with a yet smaller amount of e-liquid with improve results including much less residue.

Example G

Tobacco wax from Example A was compounded with a small amount of sodium carbonate as a buffer agent to effect a more basic pH.

We claim:

1. A vaporizable tobacco wax composition comprising tobacco wax and a vapor agent, wherein the vaporizable tobacco wax composition has a wax consistency, the vapor agent is present in the amount of 10-25% by mass, the composition has a nicotine content of 1.5-4%, the tobacco wax is extracted from tobacco using supercritical $CO_2$ extraction, and the composition has a TSNA content of less than 1 ppm.

2. The vaporizable tobacco wax composition of claim 1, further comprising a flavor.

3. The vaporizable tobacco wax composition of claim 1, further comprising a penetration agent not comprising menthol, propylene glycol or glycerin.

4. The vaporizable tobacco wax composition of claim 3, further comprising a buffer agent configured to increase nicotine absorption in a user's buccal cavity.

5. The vaporizable tobacco wax composition of claim 1, further comprising a buffer agent.

6. The vaporizable tobacco wax composition of claim 1, further comprising tobacco oil extracted from tobacco using supercritical $CO_2$ extraction.

7. The vaporizable tobacco wax composition of claim 6, wherein a mass of the tobacco oil is less than 75% of a mass of the tobacco wax.

8. The vaporizable tobacco wax composition of claim 6, wherein a mass of the tobacco oil is less than 30% of a mass of the tobacco wax.

9. The vaporizable tobacco wax composition of claim 6, wherein a mass of the tobacco oil is less than 15% of a mass of the tobacco wax.

* * * * *